US010596724B2

(12) United States Patent
Watanabe

(10) Patent No.: US 10,596,724 B2
(45) Date of Patent: Mar. 24, 2020

(54) WORKPIECE HOLDER AND METHOD FOR SLICING WORKPIECE

(71) Applicant: SHIN-ETSU HANDOTAI CO., LTD., Tokyo (JP)

(72) Inventor: Shiroyasu Watanabe, Joetsu (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 164 days.

(21) Appl. No.: 15/746,941

(22) PCT Filed: Jul. 12, 2016

(86) PCT No.: PCT/JP2016/003287
§ 371 (c)(1),
(2) Date: Jan. 23, 2018

(87) PCT Pub. No.: WO2017/017919
PCT Pub. Date: Feb. 2, 2017

(65) Prior Publication Data

US 2018/0215075 A1 Aug. 2, 2018

(30) Foreign Application Priority Data

Jul. 27, 2015 (JP) ..... 2015-148107

(51) Int. Cl.
*B28D 5/00* (2006.01)
*B28D 5/04* (2006.01)

(52) U.S. Cl.
CPC ..... *B28D 5/0088* (2013.01); *B28D 5/045* (2013.01)

(58) Field of Classification Search
CPC .... B23D 57/0061; B23D 5/00; B23D 5/0058; B23D 5/0082; B23D 5/045; B23D 7/04;
(Continued)

(56) References Cited

U.S. PATENT DOCUMENTS 4,274,389 A * 6/1981 White ..... B28D 5/0088 125/21
5,842,462 A * 12/1998 Schmid ..... B23D 57/0046 125/16.02

(Continued)

FOREIGN PATENT DOCUMENTS

DE 102004011991 A1 * 9/2005 ..... B28D 5/0088
JP H11-147217 A 6/1999

(Continued)

OTHER PUBLICATIONS

Sep. 20, 2016 International Search Report issued in International Patent Application No. PCT/JP2016/003287.

(Continued)

*Primary Examiner* — Joseph J Hail
*Assistant Examiner* — Arman Milanian
(74) *Attorney, Agent, or Firm* — Oliff PLC

(57) ABSTRACT

A workpiece holder for slicing the workpiece by a wire saw including a workpiece plate which is bonded and fixed to the workpiece through a pad plate, and a holder main body which supports the workpiece plate. The workpieces at an x axis direction and a direction vertical to the same is a y axis direction, the workpiece plate is bonded and fixed to the workpiece to correct a deviation of a crystal orientation axis of the workpiece in the x axis direction. The workpiece holder can adjust a tilt in the y axis direction of the workpiece by tilting the workpiece plate in the y axis direction. The workpiece holder can realize slicing an ingot conforming to specifications with rigorous orientation standards in an external setup manner without using a wire saw including an orientation adjustment mechanism for a single crystal ingot, and a method for slicing a workpiece.

8 Claims, 6 Drawing Sheets

(58) Field of Classification Search
CPC ..... Y10S 414/136; Y10T 83/6577; B28D 57/0061; B28D 5/00; B28D 5/0058; B28D 5/0082; B28D 5/045; B28D 7/04
USPC ..... 125/35, 21; 414/745.8; 451/365, 405; 83/435.14, 74
See application file for complete search history.

(56) References Cited

U.S. PATENT DOCUMENTS

| | | | | |
|---|---|---|---|---|
| 5,857,454 | A * | 1/1999 | Shibaoka | B28D 5/045 125/16.02 |
| 5,904,136 | A * | 5/1999 | Nagatsuka | B28D 5/045 125/16.02 |
| 6,135,102 | A * | 10/2000 | Sorimachi | B28D 5/0082 125/16.02 |
| 6,145,422 | A * | 11/2000 | Katamachi | B23Q 16/001 83/74 |
| 6,159,284 | A | 12/2000 | Olkrug et al. | |
| 6,981,495 | B2 * | 1/2006 | Muller | B23D 57/0046 125/16.02 |
| 2003/0145707 | A1 * | 8/2003 | Hauser | B23D 57/0046 83/597 |
| 2004/0168682 | A1 | 9/2004 | Hammer et al. | |
| 2014/0295126 | A1 | 10/2014 | Noguchi | |
| 2015/0375317 | A1 * | 12/2015 | Kim | B23D 57/0046 125/21 |

FOREIGN PATENT DOCUMENTS

| | | | |
|---|---|---|---|
| JP | 2000-026200 | A | 1/2000 |
| JP | 2001-050912 | A | 2/2001 |
| JP | 2004-533347 | A | 11/2004 |
| JP | 2014-195025 | A | 10/2014 |
| JP | 2015-050215 | A | 3/2015 |

OTHER PUBLICATIONS

Nov. 23, 2018 Office Action issued in Chinese Patent Applicationn No. 201680040269.X.

* cited by examiner

WORKPIECE HOLDER AND METHOD FOR SLICING WORKPIECE

TECHNICAL FIELD

The present invention relates to a workpiece holder and a method for slicing a workpiece.

BACKGROUND ART

In recent years, a workpiece such as a silicon single crystal ingot is often sliced into a wafer shape by using a wire saw. In slicing using the wire saw, first, a workpiece W to be sliced is held by such a workpiece holder 100 as show in FIG. 7 which includes a workpiece plate 102 to hold the workpiece W through a pad plate 103 and a holder main body 104 to support the workpiece plate 102. Then, the workpiece holder 100 holding the workpiece W is attached to a wire saw, and the workpiece W is pressed against a wire row formed by winding a wire which reciprocatively travels in an axial direction around a plurality of grooved rollers, whereby the workpiece is sliced into a wafer shape (see, e.g., Patent Literature 1). As shown in a side view in FIG. 8, the wire saw slices the workpiece W in a perpendicular direction of the workpiece holder 100. Further, as shown in a top view in FIG. 8, each wire forming the wire row is substantially orthogonal to the workpiece holder 100.

Slicing of the workpiece such as a single crystal ingot is performed based on a crystal plane of the single crystal ingot. However, in general, there is a deviation between a central axis of a shape of a columnar ingot and a normal line (a crystal orientation axis) to the crystal plane. This deviation will now be briefly described with reference to FIG. 9. It is to be noted that, in this specification, of radial directions of a workpiece, a direction parallel to a surface of a workpiece plate to which a workpiece is bonded and fixed is defined as an x axis direction, and a direction vertical to the same is defined as a y axis direction. In an example shown in FIG. 9, the crystal orientation axis has a deviation $\Delta x$ in the x axis direction and a deviation $\Delta y$ in the y axis direction to a central axis of a shape of a single crystal ingot.

As methods for slicing a workpiece by using a wire saw, there are a method for matching a crystal plane of a single crystal ingot with a traveling direction of a wire and then performing slicing (just angle) and a method for setting a predetermined angle between the crystal plane and the traveling direction of the wire and then performing slicing (off-angle). In both the slicing methods, when the deviations of the crystal orientation axis are present, a direction of the single crystal ingot to the wire row must be corrected before starting slicing the single crystal ingot. To carry out correction of the deviations/setting of angles of the orientation of the single crystal ingot (which will be also referred to as orientation adjustment hereinafter), for example, the following method is known.

For example, in case of bonding and fixing the ingot to the workpiece plate of the workpiece holder through the pad plate, there is a method by which the ingot is rotated around the central axis of the ingot on the pad plate to adjust the crystal orientation in the y axis direction, and then an attaching angle of the ingot to workpiece holder (a tilt in the x axis direction to the workpiece plate) is changed to adjust the crystal orientation in the x axis direction. As described above, the orientation adjustment can be carried out by adjusting a rotating position and a bonding direction of the ingot to the workpiece holder. Furthermore, such a method for adjusting the crystal orientation before attaching the single crystal ingot to the wire saw is generally called an external setup manner.

Besides, there is also a method by using a wire saw including an orientation adjustment mechanism therein, a workpiece holder having a single crystal ingot attached thereto is set, and then the orientation adjustment is performed in the wire saw. Such a method for disposing the single crystal ingot to the wire saw and then performing the crystal orientation in the wire saw is generally called an internal setup manner.

CITATION LIST

Patent Literature

Patent Literature 1: Japanese Unexamined Patent Publication (Kokai) No. 2014-195025

DISCLOSURE OF INVENTION

Problems to be Solved by the Invention

In an orientation <111>axis product of a semiconductor silicon single crystal ingot or the like, a damage difference between front and back surfaces of a sliced wafer changes and slicing quality (WARP, TTV (Total Thickness Variation), waviness, and others) greatly fluctuates depending on a slicing direction at the time of slicing the ingot (a cutting direction of the wire). For example, as shown in FIG. 10, when the slicing direction becomes each of orientations represented by directions of solid arrows, the damage difference between the front and back surfaces of the wafer is small. However, when the slicing direction becomes each of orientations represented by directions of broken arrows in FIG. 10, the damage difference between the front and back surfaces of the wafer becomes large, and slicing quality is greatly degraded. Slicing which uses a direction along which the slicing quality is greatly degraded as the slicing direction cannot be actually performed.

Thus, as described above, at the time of rotating the ingot on the pad plate to adjust the crystal orientation of the ingot in the y axis direction, when the direction along which the slicing quality is greatly degraded becomes the slicing direction, a targeted orientation is changed, and then slicing is performed. For example, in conventional examples, shifting is performed in an allowable range of specifications, and then slicing is performed. However, when an orientation standard is rigorous, since adjustment to change the targeted orientation cannot be carried out, there is a problem that a non-defective product cannot be sliced by a normal wire saw and it must be sliced by using an apparatus such as an inner diameter slicer. Thus, in slicing using the wire saw, y-axis correction which is not dependent on rotation of the ingot is required by using the external setup manner.

On the other hand, the wire saw including the orientation adjustment mechanism for the single crystal ingot is generally expensive, and the apparatus is limited. In case of the slicing method adopting the internal setup manner to perform the orientation adjustment of the single crystal ingot in the wire saw as described above, since the ingot cannot be sliced during the orientation adjustment, there occurs a problem that productivity is lowered as compared with the external setup manner.

In view of such a problem as described above, it is an object of the present invention to provide a workpiece holder which can realize slicing of an ingot conforming to specifications with a rigorous orientation standard in an external setup manner without using a wire saw including an orientation adjustment mechanism for a single crystal ingot, and a method for slicing a workpiece using this workpiece holder.

Means for Solving Problem

To achieve the object, the present invention provides a workpiece holder which is used to hold a workpiece made of a columnar single crystal at the time of slicing the workpiece by a wire saw, comprising:

a workpiece plate which is bonded and fixed to the workpiece through a pad plate; and a holder main body which supports the workpiece plate from a surface of the workpiece plate on an opposite side of another surface of the same to which the workpiece is bonded and fixed, wherein assuming that, of radial directions of the workpieces, a direction parallel to the surface of the workpiece plate to which the workpiece is bonded and fixed is an x axis direction and a direction vertical to the same is a y axis direction, the workpiece plate is bonded and fixed to the workpiece so as to correct a deviation of a crystal orientation axis of the workpiece in the x axis direction, and the workpiece holder has a function to adjust a tilt in the y axis direction of the workpiece held by the workpiece plate by tilting the workpiece plate in the y axis direction and to enable fixing the workpiece plate and the workpiece to the holder main body at the adjusted tilt.

According to the workpiece holder of the present invention, a deviation of the crystal orientation axis in the x axis direction can be corrected at the time of bonding and fixing the workpiece to the workpiece plate. Moreover, when the workpiece plate is tilted in the y axis direction, a deviation of the crystal orientation axis in the y axis direction of the workpiece to which the workpiece plate is bonded and fixed can be also corrected. When the orientation adjustment in the y axis direction is performed by using such a workpiece holder without rotating the workpiece, there is no fear that a cutting direction of a wire to a circumference of the workpiece becomes a direction along which the slicing quality is greatly degraded due to rotation of the workpiece. Thus, when the workpiece such as a single crystal ingot is sliced by using the workpiece holder of the present invention, even if the ingot is an orientation <111>axis product of a semiconductor silicon single crystal ingot, wafers having less WARPs or waviness can be sliced off. Additionally, when the workpiece according to the present invention is used, since the crystal orientation of the workpiece can be adjusted by the external setup manner, the productivity can be improved. Further, since an expensive wire saw including an orientation adjustment mechanism is not required, wafers can be sliced off at low costs.

At this time, it is preferable for the workpiece holder of the present invention that the workpiece plate has a protruding portion, which protrudes toward an outer side of the workpiece plate in a longitudinal direction and has a curved tip portion, on the surface thereof on the opposite side of another surface thereof on which the workpiece is held, the holder main body has a receiving portion which sandwiches the curved tip portion of the protruding portion from upper and lower sides, the receiving portion sandwiches the curved tip portion of the protruding portion from the upper and lower sides by two forward-and-backward movable pieces, and each of the two movable pieces is formed into a tapered shape having a tilt on a surface thereof which comes into contact with the curved tip portion of the protruding portion, and the workpiece holder is configured to tilt the workpiece plate in the y axis direction by adjusting a positional relationship of the two movable pieces, which sandwich the curved tip portion of the protruding portion, by each forward or backward movement, to adjust a tilt of the workpiece in the y axis direction, and to fix the workpiece at this position.

More specifically, the workpiece holder according to the present invention can be provided with such a structure.

At this time, it is preferable that a tilt of a tapered surface of each of the two movable pieces, which comes into contact with the curved tip portion of the protruding portion, is 30° to 60°.

Each movable piece in the present invention can have such a tilt of the tapered surface, such a tilt facilitates adjustment of the tilt of the workpiece plate in the y axis direction and assuredly enables fixation. When the tilt of the tapered surface is 30° or more, an angle adjustment amount of the tilt of the workpiece plate to a movement amount of the movable pieces can become sufficiently large, and a time required for the adjustment can be reduced. Furthermore, when the tilt of the tapered surface is 60° or less, the angle adjustment amount of the tilt of the workpiece plate to the movement amount of the movable piece does not become too large, and hence the delicate angle adjustment can be facilitated.

At this time, it is preferable that the workpiece plate has the two protruding portions at both ends thereof in the longitudinal direction, the holder main body has the two receiving portions, and the receiving portions sandwich the curved tip portions of the two protruding portions from the upper and lower sides, respectively.

As described above, when the tilt of the workpiece plate can be adjusted at both the ends of the workpiece plate in the longitudinal direction, the tilt of the workpiece in the y axis direction can be more accurately and easily adjusted, and the workpiece can be fixed.

Moreover, to achieve the object, the present invention provides a method for slicing a workpiece, comprising pressing a workpiece made of a columnar single crystal held by a workpiece holder against a wire row of a wire saw to slice the workpiece with the use of the wire saw comprising the wire row formed by winding a wire which reciprocatively travels in an axial direction around a plurality of grooved rollers, wherein the workpiece holder comprises:

a workpiece plate which is bonded and fixed to the workpiece through a pad plate; and a holder main body which supports the workpiece plate from a surface of the workpiece plate on an opposite side of another surface of the same to which the workpiece is bonded and fixed, assuming that, of radial directions of the workpieces, a direction parallel to the surface of the workpiece plate to which the workpiece is bonded and fixed is an x axis direction and a direction vertical to the same is a y axis direction, the workpiece plate is bonded and fixed to the workpiece so as to correct a deviation of a crystal orientation axis of the workpiece in the x axis direction , the workpiece holder having a function to adjust a tilt in the y axis direction of the workpiece held by the workpiece plate by tilting the workpiece plate in the y axis direction and to enable fixing the workpiece plate and the workpiece to the holder main body at the adjusted tilt is used, the workpiece plate is bonded and fixed to the workpiece so as to correct a deviation of the crystal orientation axis of the workpiece in the x axis direction at the time of holding the workpiece by the workpiece holder, a tilt in the y axis direction of the workpiece held by the workpiece plate is adjusted by tilting the workpiece plate bonded and fixed to the workpiece in the y axis direction, and the workpiece is held by the workpiece holder by fixing the workpiece plate and the workpiece to the holder main body at the adjusted tilt, and the workpiece fixed by adjusting the tilt is disposed to the wire saw through the workpiece holder, and the workpiece is pressed against the wire row to slice the workpiece.

According to the method for slicing a workpiece of the present invention, when the workpiece plate, which is bonded and fixed to the workpiece so as to correct a deviation of the crystal orientation axis of the workpiece in the x axis direction, is further tilted in the y axis direction, a deviation of the crystal orientation axis of the workpiece in the y axis direction can be also corrected. According to such a method, when the orientation adjustment in the y axis direction is performed without rotating the workpiece, there is no fear that a cutting direction of the wire to a circumference of the workpiece becomes a direction along which the slicing quality is greatly degraded due to rotation of the workpiece. Thus, when the workpiece such as a single crystal ingot is sliced by the slicing method of the present invention, even if the ingot is an orientation <111>axis product of a semiconductor silicon single crystal ingot, wafers having less WARPs or waviness can be sliced off. Additionally, according to the slicing method of the present invention, since the crystal orientation of the workpiece can be adjusted by the external setup manner, the productivity can be improved. Further, an expensive wire saw including an orientation adjustment mechanism is not required, and hence the wafers can be sliced off at low costs.

At this time, in the method for slicing a workpiece according to the present invention, it is possible that as the workpiece holder, the workpiece plate has a protruding portion, which protrudes toward an outer side of the workpiece plate in a longitudinal direction and has a curved tip portion, on the surface thereof on the opposite side of another surface thereof on which the workpiece is held, the holder main body has a receiving portion which sandwiches the curved tip portion of the protruding portion from upper and lower sides, the receiving portion sandwiches the curved tip portion of the protruding portion from the upper and lower sides by two forward-and-backward movable pieces, and each of the two movable pieces is formed into a tapered shape having a tilt on a surface thereof which comes into contact with the curved tip portion of the protruding portion, and as the workpiece holder, adopted is one which is configured to tilt the workpiece plate in the y axis direction by adjusting a positional relationship of the two movable pieces, which sandwich the curved tip portion of the protruding portion, by each forward or backward movement, to adjust a tilt of the workpiece in the y axis direction, and to fix the workpiece at this position.

More specifically, the method for slicing a workpiece according to the present invention can be carried out by using the workpiece holding having such a structure.

Further, at this time, in the method for slicing a workpiece according to the present invention, it is possible that the two movable pieces each of which has a tapered surface, which comes into contact with the curved tip portion of the protruding portion, tilting at 30° to 60° are used.

As each movable piece which can be used in the present invention, the one having such a tilt of the tapered surface can be adopted, and such a tilt facilitates adjustment of the tilt of the workpiece plate in the y axis direction and assuredly enables fixation. When the tilt of the tapered surface is 30° or more, an angle adjustment amount of the tilt of the workpiece plate to a movement amount of the movable pieces can become sufficiently large, and a time required for the adjustment can be reduced. Furthermore, when the tilt of the tapered surface is 60° or less, the angle adjustment amount of the tilt of the workpiece plate to the movement amount of the movable pieces does not become too large, and hence the delicate angle adjustment can be facilitated.

At this time, in the method for slicing a workpiece according to the present invention, it is preferable that as the workpiece holder, adopted is one in which the workpiece plate has the two protruding portions at both ends thereof in the longitudinal direction, the holder main body has the two receiving portions, and the receiving portions sandwiching the curved tip portions of the two protruding portions from the upper and lower sides, respectively.

As described above, when the workpiece holder which can adjust the tilt of the workpiece plate at both the ends of the workpiece plate in the longitudinal direction is used, the tilt of the workpiece in the y axis direction can be more accurately and easily adjusted, and the workpiece can be fixed.

Effect of the Invention

According to the workpiece holder and the method for slicing a workpiece of the present invention, it is possible to realize slicing a single crystal ingot conforming to specifications with a rigorous orientation standard by the external setup manner without using a wire saw including an orientation adjustment mechanism for the single crystal ingot.

BEST MODE(S) FOR CARRYING OUT THE INVENTION

An embodiment according to the present invention will now be described hereinafter, but the present invention is not restricted thereto.

As described above, according to the external setup manner, in conventional examples, before bonding and fixing a workpiece to a workpiece plate, an ingot is rotated around a central axis thereof on a pad plate of a workpiece holder to correct a deviation of a crystal orientation in a y axis direction. However, in an orientation <111>axis product of a semiconductor silicon single crystal ingot or the like, there is a case where WARPs, TTVs, and waviness are greatly degraded depending on a cutting direction of a wire, and hence the cutting direction of the wire becomes a direction in which slicing quality is largely degraded as a result of rotating the ingot in some situations. In this case, to shift the cutting direction of the wire, the ingot must be rotated to change a targeted orientation but, when an orientation standard is rigorous, adjustment to change this targeted orientation cannot be performed, and hence there arises a problem that a non-defective product cannot be sliced by a normal wire saw. Furthermore, in an internal setup manner, the wire saw is expensive, and efficiency in slicing is lowered, which results in a problem of degradation of productivity.

On the other hand, the present inventors have repeatedly conducted keen examinations to solve such a problem, and discovered that the problem can be solved by adjusting a deviation of the crystal orientation in the y axis direction irrespective of rotation of a workpiece with the use of a workpiece holder which can tilt the workpiece in the y axis direction, thereby bringing the present invention to completion.

Figure 1:
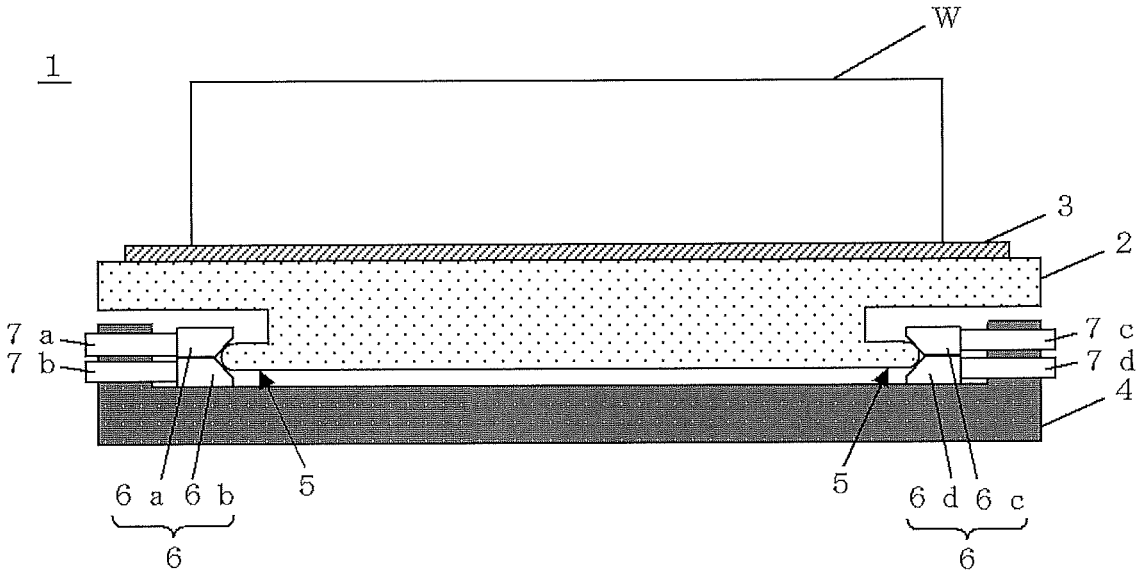
FIG. 1 is a longitudinal cross-sectional view showing an outline of a workpiece holder according to the present invention.

As shown in FIG. 1, a workpiece holder 1 according to the present invention includes a workpiece plate 2 which is bonded and fixed to a workpiece W through a pad plate 3, and a holder main body 4 which supports the workpiece plate 2 from a surface of the workpiece plate 2 on the opposite side of another surface of the same to which the workpiece W is bonded and fixed.

Figure 2:
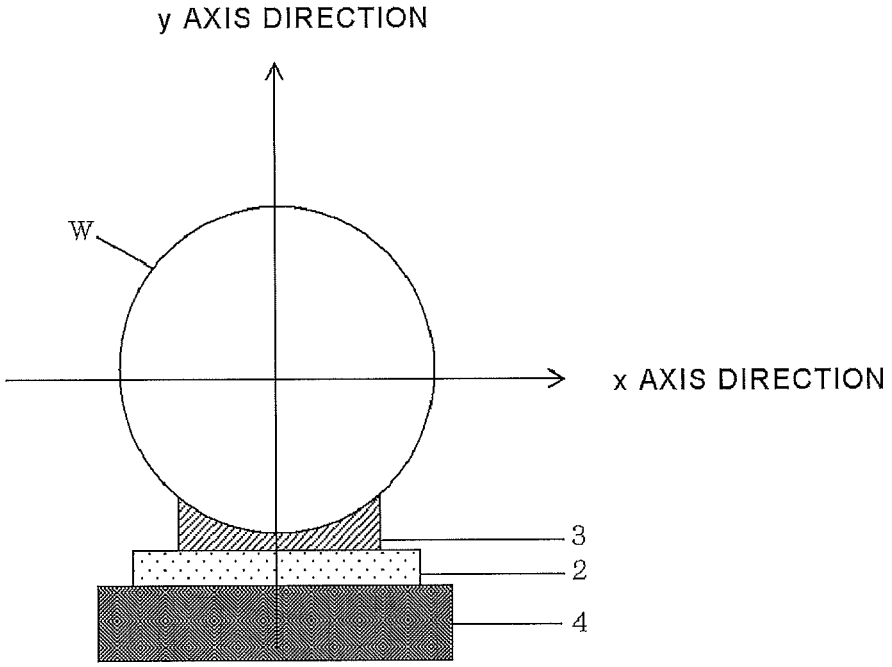
FIG. 2 is a view for explaining definitions of an x axis direction and a y axis direction (a lateral cross-sectional view)
Figure 3:
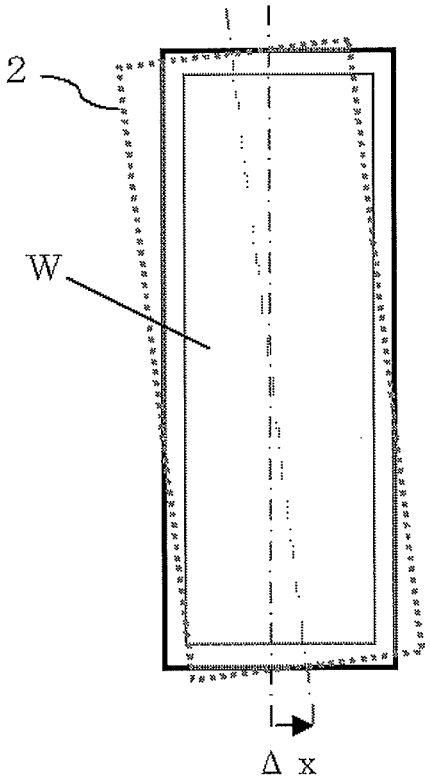
FIG. 3 is an explanatory drawing of a workpiece plate which is bonded and fixed to the workpiece so as to correct a deviation of a crystal orientation axis of a workpiece in the x axis direction.

Moreover, as described above, in this specification, as shown in FIG. 2, of radial directions of the columnar workpiece W, a direction parallel to the surface of the workpiece plate 2 to which the workpiece W is bonded and fixed is defined as an x axis direction, and a direction vertical to the same is defined as a y axis direction. In this case, as shown in FIG. 3, the workpiece plate 2 in the workpiece holder 1 according to the present invention is bonded and fixed to the workpiece W so as to correct a deviation of a crystal orientation axis of the workpiece W in the x axis direction. In the example shown in FIG. 3, the workpiece plate 2 is bonded and fixed to the workpiece W so as to correct a deviation Ax of the crystal orientation axis in the x axis direction.

Additionally, the workpiece holder 1 according to the present invention has a function to adjust a tilt of the workpiece plate 2 in the y axis direction by tilting the workpiece plate 2 bonded and fixed to the workpiece W in the y axis direction and to enable fixing the workpiece plate 2 and the workpiece W to the holder main body 4 at the adjusted tilt. It is to be noted that the workpiece holder 1 can tilt and fix the workpiece plate 2 in both a state where the workpiece plate 2 is bonded and fixed to the workpiece W and a state where the same is not bonded and fixed to the workpiece W.

Such a function can be provided by, e.g., such a structure of the workpiece holder as described below. As shown in FIG. 1, the workpiece plate 2 has a protruding portion 5 with a curved tip portion on its surface on the opposite side of its another surface on which the workpiece W is held. This protruding portion 5 can protrude toward the outer side of the workpiece plate 2 in the longitudinal direction as shown in FIG. 1. It is to be noted that the curved shaped mentioned here means, e.g., a semicolumnar shape or a semispherical shape. For example, FIG. 1 shows an example where the tip of the protruding portion 5 is formed into a semicolumnar shape, but the present invention is not restricted thereto.

Additionally, the holder main body 4 has a receiving portion 6 which sandwiches the curved tip portion of the protruding portion 5 from upper and lower sides. This receiving portion 6 sandwiches the curved tip portion of the protruding portion 5 by using two movable pieces 6*a* and 6*b* or two movable pieces 6*c* and 6*d* which can move forward and backward.

Further, each of the two movable pieces 6*a* and 6*b* (6*c* and 6*d*) is formed into a tapered shape having a tilt on its surface which comes into contact with the curved tip portion of the protruding portion 5. It is to be noted that the movable pieces 6*a* and 6*b* (6*c* and 6*d*) can be moved forward and backward by using adjustment screws 7*a* and 7*b* (7*c* and 7*d*) connected to the respective movable pieces 6*a* and 6*b* (6*c* and 6*d*).

Furthermore, it is preferable for the tilt of the tapered surface of each of the two movable pieces 6*a* and 6*b*, which comes into contact with the curved tip portion of the protruding portion 5, to be 30° to 60°. The movable pieces each of which has the tapered surface tilting in this range realize an appropriate tilt, facilitate adjusting the tilt of the workpiece plate 2 in the y axis direction, provide sufficient strength, and assuredly enable fixing and holding the workpiece which is a heavy load. Moreover, when the tilt of the tapered surface is set to 30° or more, an angle adjustment amount of the tilt of the workpiece plate to a movement amount of the movable pieces becomes sufficiently large, and a time required for the adjustment can be reduced. Additionally, when the tilt of the tapered surface is set to 60° or less, the angle adjustment amount of the tilt of the workpiece plate to the movement amount of the movable pieces does not become too large, and hence delicate angle adjustment can be facilitated.

Additionally, as shown in FIG. 1, it is preferable that the workpiece plate 2 has two protruding portions 5 at both ends in the longitudinal direction, the holder main body 4 has receiving portions 6, and each receiving portion 6 sandwiches the curved tip portion of each of the two protruding portions 5 from the upper and lower sides. As described above, when the tilt of the workpiece plate 2 can be adjusted from both the end portions of the workpiece plate 2 in the longitudinal direction, the tilt of the workpiece bonded to the workpiece plate 2 in the y axis direction can be easily adjusted, and the workpiece can be fixed.

With such a structure as shown in FIG. 1, the workpiece holder 1 can tilt the workpiece plate 2 in the y axis direction by adjusting a positional relationship of the two movable pieces sandwiching the curved tip portion of the protruding portion 5 therebetween based on the forward and backward movements of each piece, adjust the tilt in the y axis direction of the workpiece W to which the workpiece plate 2 is bonded and fixed, and effect the fixation at this position.

Figure 4:
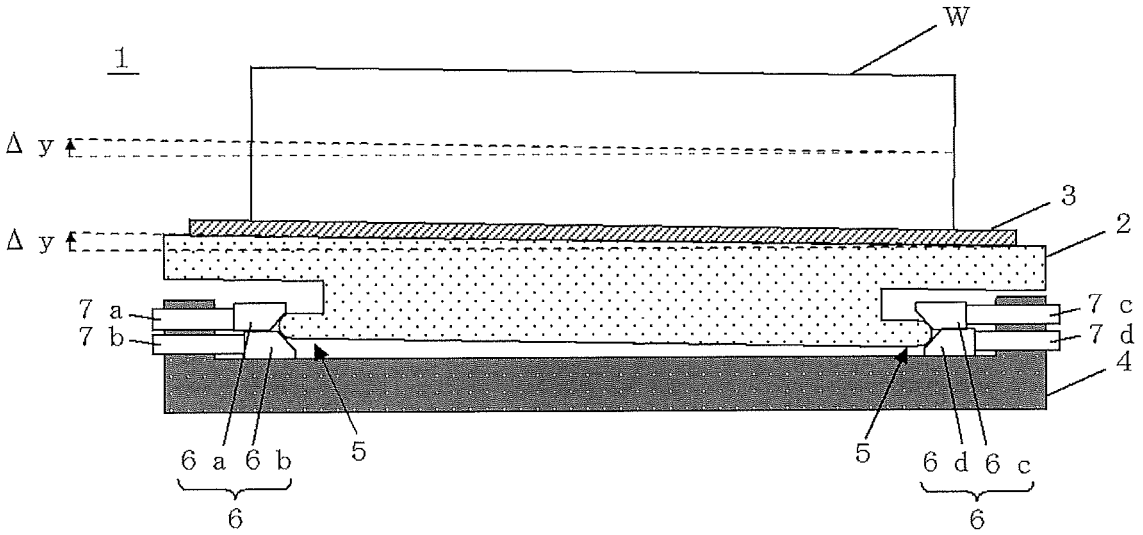
FIG. 4 is a schematic drawing of a mode in which the workpiece plate and the workpiece of the workpiece holder according to the present invention are fixed at a tilt.

Here, as a specific example, a description will be given as to a case where, to correct the deviation Ay of the crystal orientation axis in the y axis direction of the workpiece bonded and fixed to the workpiece plate 2, the workpiece plate 2 is tilted by the workpiece holder 1 according to the present invention in such a manner that a left end of the workpiece plate 2 in FIG. 1 is placed on an upper side and a right end of the same is placed on a lower side. As shown in FIG. 4, in the receiving portion 6 on the left end side, the movable piece 6*a* is retracted toward an outer side of the longitudinal direction of the workpiece plate 2, and the movable piece 6*b* is advanced toward an inner side of the workpiece plate 2 in the longitudinal direction. Further, in the receiving portion 6 on the right end side, the movable piece 6*c* is advanced toward the inner side of the workpiece plate 2 in the longitudinal direction, and the movable piece 6*d* is retracted toward the outer side of the workpiece plate 2 in the longitudinal direction. When the positional relationships between the respective movable pieces 6*a*, 6*b*, 6*c*, and 6*d* are adjusted in this manner, tilting the workpiece plate 2 and fixing the workpiece plate 2 and the workpiece W on the holder main body 4 at this position enable correcting the deviation Δy in the y axis direction.

As described above, the workpiece holder according to the present invention can correct the deviation of the crystal orientation axis in the x axis direction at the time of bonding and fixing the workpiece plate to the workpiece. Furthermore, tilting the workpiece plate in the y axis direction enables performing the orientation adjustment in the y axis direction without rotating the workpiece.

Thus, as different from a case where the workpiece is rotated on the pad plate in conventional examples, there is no fear that a cutting direction of a wire to a circumference of the workpiece becomes a direction to considerably degrade the slicing quality due to the rotation of the workpiece. That is, when a single crystal ingot is sliced by using the workpiece holder according to the present invention, wafers having less WARPs or waviness can be sliced off by the external setup manner even if crystal orientation standards are rigorous. Moreover, when the workpiece holder according to the present invention is used, since the crystal orientation of the workpiece can be adjusted by the external setup manner, the productivity in slicing can be improved. Additionally, since an expensive wire saw including an orientation adjustment mechanism is not required, the wafers can be sliced off at low costs.

It is to be noted that, in FIG. 1 and FIG. 4, the mode where the workpiece plate is tilted in a state where the workpiece plate 2 is bonded and fixed to the workpiece W has been described as an example, but a work order is not restricted to this order. For example, the workpiece plate 2 may be tilted and fixed in advance in correspondence with a deviation in the y axis direction of the crystal orientation axis of the workpiece W to be held, and then the workpiece plate 2 may be bonded and fixed to the workpiece W while correcting the deviation of the crystal orientation axis of the workpiece W in the x axis direction.

A method for slicing a workpiece according to the present invention will now be described. Here, a description will be given as to a case where the workpiece holder 1 according to the present invention is used.

The method for slicing a workpiece according to the present invention uses a wire saw, and a workpiece made of a columnar single crystal held by the workpiece holder is pressed against a wire row, thereby slicing the workpiece. More specifically, such a wire saw as shown in FIG. 5 can be used.

Figure 5:
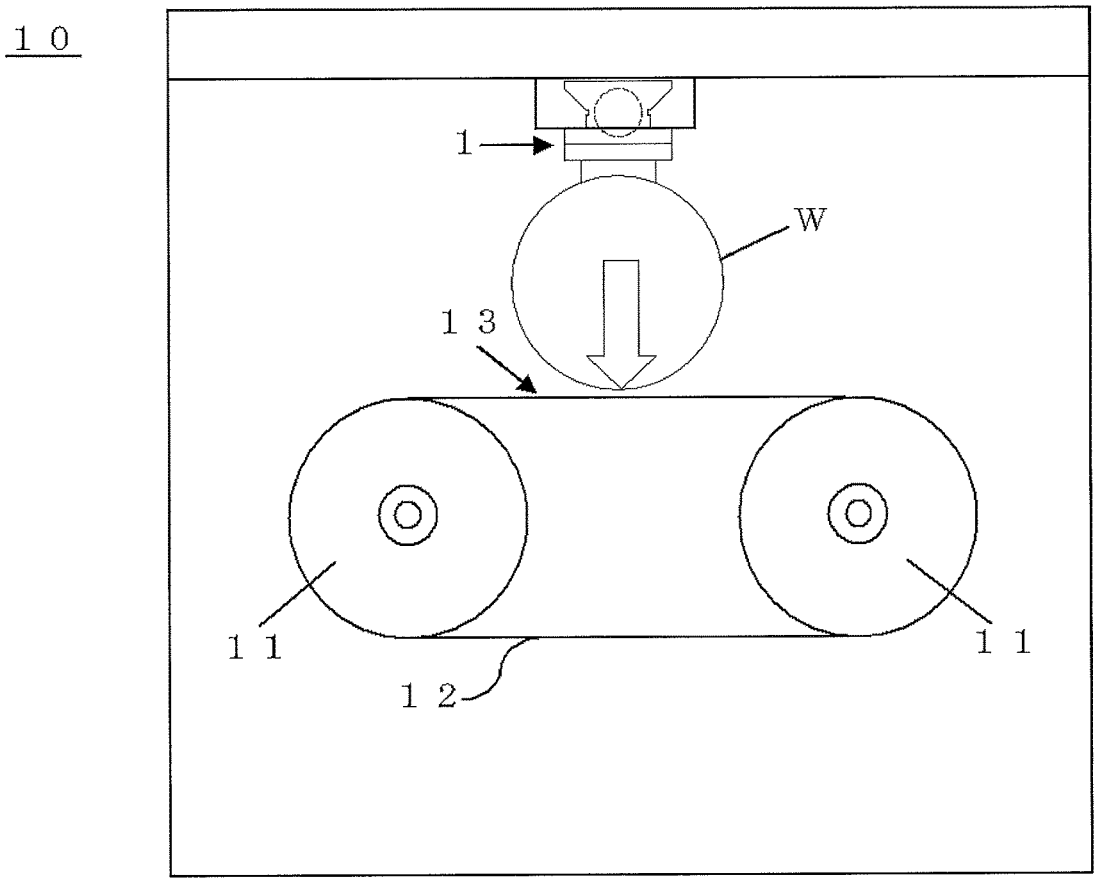
FIG. 5 is a schematic view showing an example of a wire saw which can be used in a method for slicing a workpiece according to the present invention.

As shown in FIG. 5, a wire saw 10 includes a wire row 13 formed by winding a wire 12, which reciprocatively travels in an axial direction, around a plurality of grooved rollers 11. Such a wire saw 10 presses the workpiece W made of a columnar single crystal held by the workpiece holder 1 against the wire row 13 of the wire saw 10, thereby slicing the workpiece W into a wafer shape.

The method for slicing a workpiece according to the present invention is a slicing method adopting an external setup manner to perform orientation adjustment of the workpiece before the workpiece W is attached to the wire saw 10 through the workpiece holder 1. More specifically, first, as shown in FIG. 3, at the time of holding the workpiece W by the workpiece holder 1, the workpiece plate 2 is bonded and fixed to the workpiece W so as to correct a deviation of the crystal orientation axis of the workpiece W in the x axis direction (S1 in FIG. 6).

Subsequently, as shown in FIG. 4, the workpiece plate 2 bonded and fixed to the workpiece W is tilted in the y axis direction to adjust the tilt in the y axis direction of the workpiece held by the workpiece plate 2 (S2 in FIG. 6). Further, the workpiece plate 2 and the workpiece W are fixed to the holder main body 4 at this adjusted tilt to hold the workpiece W by using the workpiece holder 1 (S3 in FIG. 6). Consequently, the orientation adjustment of the workpiece W is completed.

Figure 6:
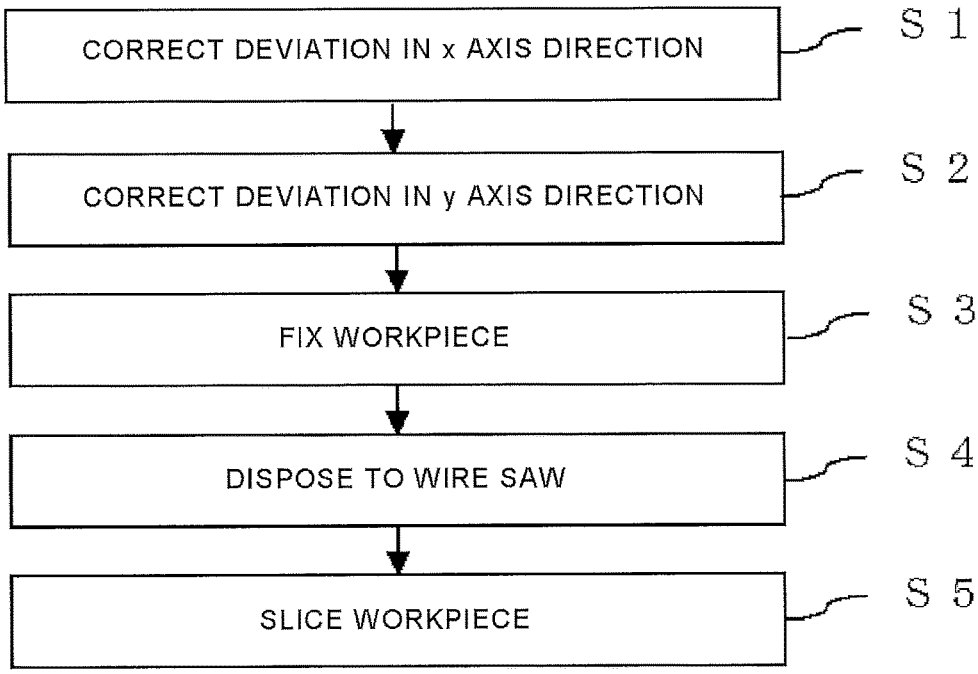
FIG. 6 is a flowchart showing an example of the method for slicing a workpiece according to the present invention.
Figure 7:
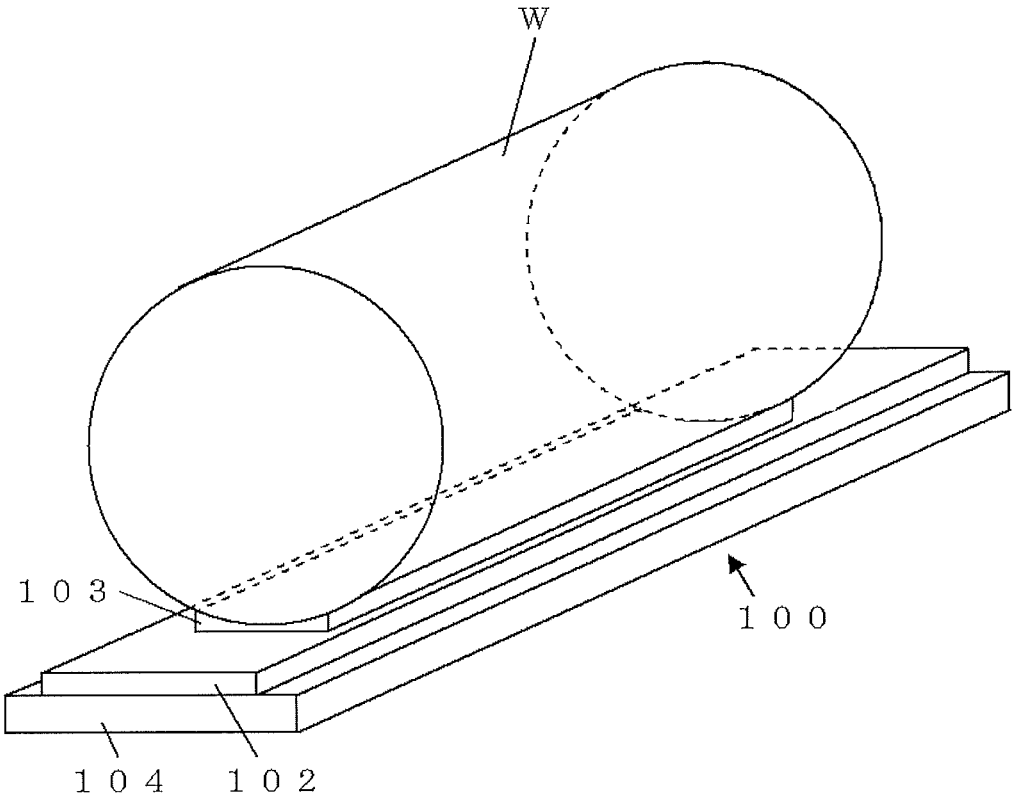
FIG. 7 is a schematic view of a conventional workpiece holder.
Figure 8:
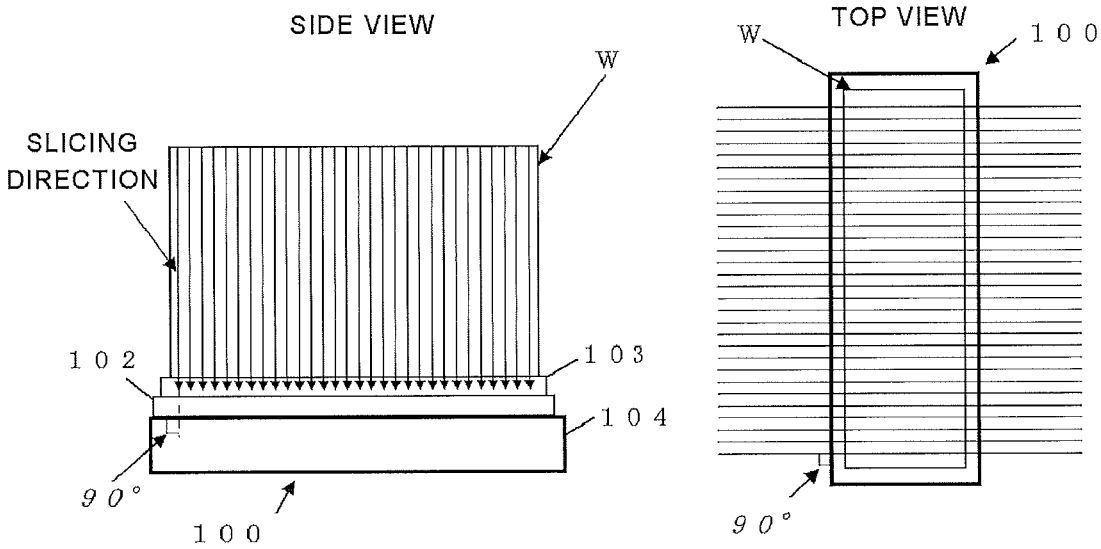
FIG. 8 is a side view and a top view for explaining a slicing direction of the wire saw.
Figure 9:
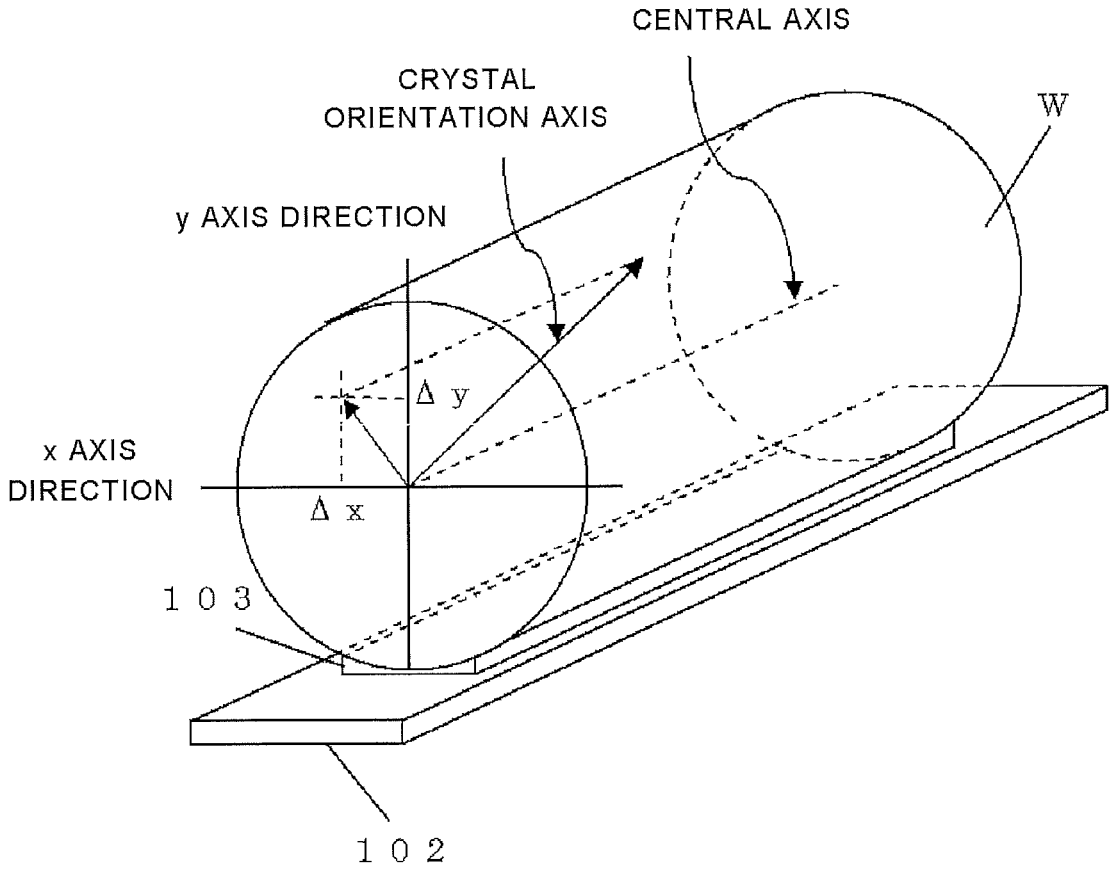
FIG. 9 is an explanatory drawing of deviations of a crystal orientation axis of a single crystal ingot.

Then, as shown in FIG. 5, the workpiece W having the fixed tilt is disposed to the wire saw 10 through the workpiece holder 1 (S4 in FIG. 6). Subsequently, the workpiece W is pressed against the wire row 13 in FIG. 5 to slice the workpiece W (S5 in FIG. 6).

According to such a method for slicing a workpiece of the present invention, at the time of bonding and fixing the workpiece plate to the workpiece, the deviation of the crystal orientation axis in the x axis direction is corrected, and then the workpiece is tilted in a state where the workpiece is fixed to the workpiece plate to thereby perform the orientation adjustment in the y axis direction irrespective of rotation of the workpiece. Thus, as different from the example using the method for rotating the workpiece on the pad plate, there is no fear that a cutting direction of the wire to the circumference of the workpiece becomes a direction to considerably degrade the slicing quality. Thus, when a single crystal ingot is sliced by the method for slicing a workpiece according to the present invention, wafers having less WARPs or waviness can be sliced off even though crystal orientation standards are rigorous. Furthermore, since the method for slicing a workpiece according to the present invention enables adjusting the crystal orientation of the workpiece in the external setup manner, the productivity can be improved. Moreover, since an expensive wire saw including an orientation adjustment mechanism is not required, wafers can be sliced off at low costs.

Additionally, in the method for slicing a workpiece of the present invention, as the workpiece holder, it is possible to use such a workpiece holder 1 as shown in FIG. 1 in which the workpiece plate 2 has the protruding portions 5 and the holder main body 4 has the receiving portions 6 each of which is formed of the two movable pieces which sandwich the curved tip portion of each protruding portion 5 from the upper and lower sides. Using such a workpiece holder 1 enables accurately performing the orientation adjustment in the y axis direction.

Further, it is preferable to use the two movable pieces 6*a* and 6*b* (the movable pieces 6*c* and 6*d*) each of which has the tapered surface, which comes into contact with the curved tip portion of the protruding portion 5, being tilted at 30° to 60°. The movable pieces whose tapered surfaces have such a tilt can facilitate adjusting the tilt of the workpiece plate 2 in the y axis direction. Further, when the tilt of each tapered surface is set to 30° or more, an angle adjustment amount of the tilt of the workpiece plate to a movement amount of each movable piece becomes sufficiently large, and a time required for the adjustment can be reduced. Furthermore, when the tilt of each tapered surface is set to 60° or less, the angle adjustment amount of the tilt of the workpiece plate to the movement amount of each movable piece does not become too large, and hence delicate angle adjustment can be facilitated.

Moreover, as shown in FIG. 1, in the slicing method according to the present invention, it is preferable that the workpiece plate 2 has the two protruding portions 5 at both ends thereof in the longitudinal direction, the holder main body 4 has the two receiving portions 6, and the receiving portions 6 sandwich the curved tip portions of the two protruding portions 5 from the upper and lower sides, respectively. As described above, when the tilt of the workpiece plate can be adjusted from both the ends of the workpiece plate in the longitudinal direction, the tilt of the workpiece in the y axis direction can be accurately adjusted, and the workpiece can be fixed.

EXAMPLES

Although the present invention will now be more specifically described hereinafter with reference to examples and comparative examples of the present invention, the present invention is not restricted to these examples.

Example 1

Such a workpiece holder 1 of the present invention as shown in FIG. 1 was used, and a workpiece was sliced by using a silicon single crystal ingot having a diameter of 200 mm and a crystal axis <100>in conformity to a flow of the method for slicing a workpiece of the present invention shown in FIG. 6.

In Example 1, the workpiece plate 2 was bonded and fixed to the ingot in such a manner that a deviation of the ingot having the crystal axis <100>in the x axis direction becomes 0 minute, an angle of the workpiece plate 2 was adjusted in such a manner that a deviation of the ingot in the y axis direction becomes 20 minutes, and the ingot was fixed to the holder main body 4. As described above, the ingot held by the workpiece holder 1 of the present invention was disposed to such a wire saw 10 as shown in FIG. 5, and sliced.

Example 2

An ingot was sliced under the same conditions as those in Example 1 except that the ingot to be sliced was changed to one having a crystal axis <111>.

Table 1 shows plane orientations, TTVs, and WARPs of sliced wafers in Examples 1 and 2.

TABLE 1

| | | | | | | | Shape(μm) | | |
|---|---|---|---|---|---|---|---|---|---|
| | | | Crystal orientation | | | | Ingot | | |
| | | | | Wafer | | | position | | |
| | Crystal axis | Direction | Target | Actual measurement | Difference | | Operation level | TTV 10 | WARP 15 |
| Example 1 | <100> | x | 0 minute | 2 minutes | 2 minutes | | One end | 8.7 | 14.6 |
| | | | | | | | Center | 6.9 | 9.7 |
| | | y | 20 minutes | 20 minutes | 0 minute | | Other end | 9.7 | 12.0 |
| | | | | | | | Average | 8.4 | 12.1 |
| Example 2 | <111> | x | 0 minute | 2 minutes | 2 minutes | | One end | 8.0 | 11.7 |
| | | | | | | | Center | 6.5 | 13.2 |
| | | y | 20 minutes | 20 minutes | 0 minute | | Other end | 9.8 | 15.6 |
| | | | | | | | Average | 8.1 | 13.5 |

As can be understood from Table 1, in Examples 1 and 2, each of differences between targeted orientations and actual measured values was two minutes or less in the x axis direction, and it was one minute or less in the y axis direction. Usually, this difference is approximately ±10 minutes, and hence it can be said that wafers each having the targeted plane orientation was able to be accurately sliced off.

Further, as to the TTVs and WARPs of the wafers, when a crystal axis <100>product or a single crystal ingot having the crystal axis <111>fixed at an appropriate ingot slicing position was sliced by the slicing method adopting the external setup manner which includes the conventional procedure of rotating the ingot on the pad plate, the TTVs are approximately 10 μm, and the WARPs are approximately 15 μm. As can be understood from Table 1, the TTVs and WARPs of the wafers sliced off in Examples 1 and 2 are suppressed to the same level as those in conventional examples. Since the slicing method according to the present invention does not include the procedure to rotate the ingot on the pad plate, degradation of the WARPs and TTVs can be likewise suppressed in slicing of an orientation <111>axis product of a silicon single crystal ingot.

Comparative Example 1

Figure 10:
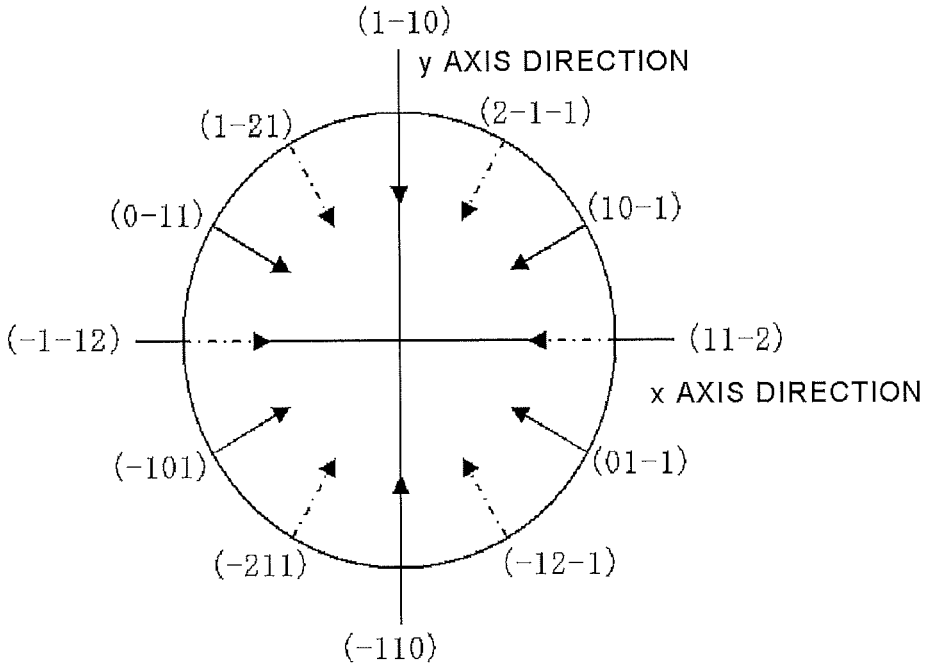
FIG. 10 is a view for explaining a change in slicing quality due to directions to slice an ingot by the wire saw.

A silicon single crystal ingot was rotated on the pad plate of the workpiece holder, a crystal orientation in the y axis direction was adjusted, and an attaching angle of the ingot to the workpiece holder (a tilt in the x axis direction to the workpiece plate) was changed to adjust a crystal orientation in the x axis direction, thereby performing orientation adjustment. Then, the workpiece holder was attached to the wire saw, and the ingot was sliced. The silicon single crystal ingot used in this example is a product having a diameter of 200 mm and an orientation <111>axis. Further, a slicing direction was a (−110) direction in FIG. 10.

Comparative Example 2

An ingot was sliced like Comparative Example 1 except that the silicon single crystal ingot was rotated more by 15° on the pad plate of the workpiece holder than in Comparative Example 1 to adjust a crystal orientation in the y axis direction.

Comparative Example 3

An ingot was sliced like Comparative Example 1except that the silicon single crystal ingot was rotated more by 30° on the pad plate of the workpiece holder than in Comparative Example 1 to adjust a crystal orientation in the y axis direction. A slicing direction in this example was a (−12−1) direction in FIG. 10.

Figure 11:
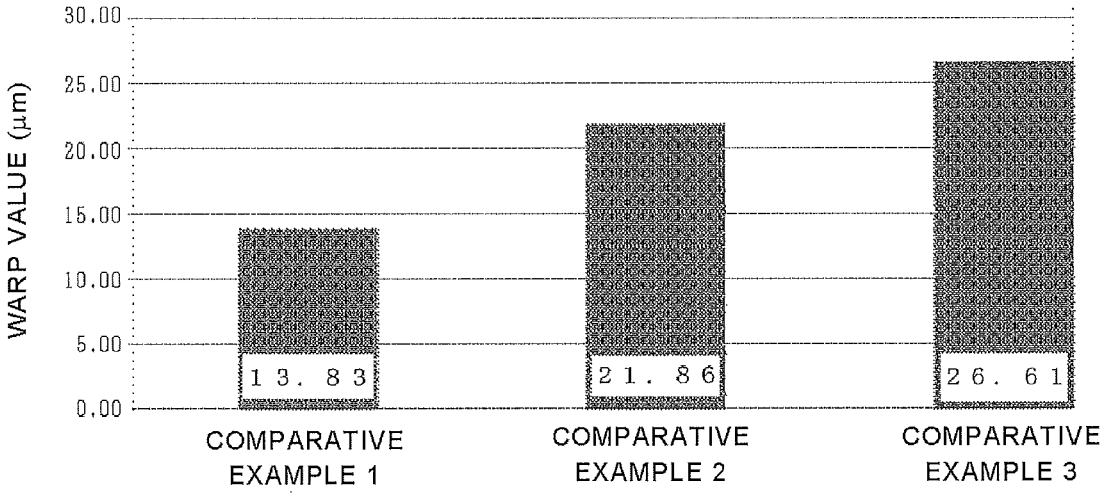
FIG. 11 is a graph showing average values of WARPs of wafers sliced off in Comparative Examples 1 to 3.

FIG. 11 show WARP values of wafers sliced off in Comparative Examples 1 to 3. The WARP of the wafer changed in correspondence with a rotation amount, and in Comparative Example 3 where the slicing direction became (−12−1) in particular, the WARP value was extremely increased. As described above, according to the conventional method, it was confirmed that, when the orientation <111>axis product was sliced, flatness of the wafer might be impaired.

It is to be noted that the present invention is not restricted to the embodiment. The embodiment is an illustrative example, and any example which has substantially the same structure and exerts the same functions and effects as the technical concept described in claims of the present invention is included in the technical scope of the present invention.

The invention claimed is:

1. A workpiece holder which is used to hold a workpiece made of a columnar single crystal at the time of slicing the workpiece by a wire saw, comprising:

a workpiece plate which is bonded and fixed to the workpiece through a pad plate; and a holder main body which supports the workpiece plate from a surface of the workpiece plate, the surface being an opposite side of another surface of the workpiece plate to which the workpiece is bonded and fixed, wherein assuming that, of radial directions of the workpieces, a direction parallel to the surface of the workpiece plate to which the workpiece is bonded and fixed is an x axis direction and a direction vertical to the surface of the workpiece plate to which the workpiece is bonded and fixed is a y axis direction, the workpiece plate is bonded and fixed to the workpiece so as to correct a deviation of a crystal orientation axis of the workpiece in the x axis direction, the workpiece holder has a function to adjust a tilt in the y axis direction of the workpiece held by the workpiece plate by tilting the workpiece plate in the y axis direction and to enable fixing the workpiece plate and the workpiece to the holder main body at the adjusted tilt, the workpiece plate has a protruding portion, which protrudes toward an outer side of the workpiece plate in a longitudinal direction and has a curved tip portion, on the surface thereof on the opposite side of another surface thereof on which the workpiece is held, the holder main body has a receiving portion which sandwiches the curved tip portion of the protruding portion from upper and lower sides, the receiving portion sandwiches the curved tip portion of the protruding portion from the upper and lower sides by two forward-and-backward movable pieces, and each of the two movable pieces is formed into a tapered shape having a tilt on a surface thereof which comes into contact with the curved tip portion of the protruding portion, and the workpiece holder is configured to tilt the workpiece plate in the y axis direction by adjusting a positional relationship of the two movable pieces, which sandwich the curved tip portion of the protruding portion, by each forward or backward movement, to adjust a tilt of the workpiece in the y axis direction, and to fix the workpiece at this position.

2. The workpiece holder according to claim 1, wherein a tilt of a tapered surface of each of the two movable pieces, which comes into contact with the curved tip portion of the protruding portion, is 30° to 60°.

3. The workpiece holder according to claim 1, wherein the workpiece plate has the two protruding portions at both ends thereof in the longitudinal direction, the holder main body has the two receiving portions, and the receiving portions sandwich the curved tip portions of the two protruding portions from the upper and lower sides, respectively.

4. The workpiece holder according to claim 2, wherein the workpiece plate has the two protruding portions at both ends thereof in the longitudinal direction, the holder main body has the two receiving portions, and the receiving portions sandwich the curved tip portions of the two protruding portions from the upper and lower sides, respectively.

5. A method for slicing a workpiece, comprising pressing a workpiece made of a columnar single crystal held by a workpiece holder against a wire row of a wire saw to slice the workpiece with the use of the wire saw comprising the wire row formed by winding a wire which reciprocatively travels in an axial direction around a plurality of grooved rollers, wherein the workpiece holder comprises:

a workpiece plate which is bonded and fixed to the workpiece through a pad plate; and a holder main body which supports the workpiece plate from a surface of the workpiece plate, the surface being an opposite side of another surface of the workpiece plate to which the workpiece is bonded and fixed, assuming that, of radial directions of the workpieces, a direction parallel to the surface of the workpiece plate to which the workpiece is bonded and fixed is an x axis direction and a direction vertical to the surface of the workpiece plate to which the workpiece is bonded and fixed is a y axis direction, the workpiece plate is bonded and fixed to the workpiece so as to correct a deviation of a crystal orientation axis of the workpiece in the x axis direction, the workpiece holder has a function to adjust a tilt in the y axis direction of the workpiece held by the workpiece plate by tilting the workpiece plate in the y axis direction and to enable fixing the workpiece plate and the workpiece to the holder main body at the adjusted tilt, the workpiece plate has a protruding portion, which protrudes toward an outer side of the workpiece plate in a longitudinal direction and has a curved tip portion, on the surface thereof on the opposite side of another surface thereof on which the workpiece is held, the holder main body has a receiving portion which sandwiches the curved tip portion of the protruding portion from upper and lower sides, the receiving portion sandwiches the curved tip portion of the protruding portion from the upper and lower sides by two forward-and-backward movable pieces, and each of the two movable pieces is formed into a tapered shape having a tilt on a surface thereof which comes into contact with the curved tip portion of the protruding portion, and the workpiece holder being configured to tilt the workpiece plate in the y axis direction by adjusting a positional relationship of the two movable pieces, which sandwich the curved tip portion of the protruding portion, by each forward or backward movement, to adjust a tilt of the workpiece in the y axis direction, and to fix the workpiece at this position, the workpiece plate is bonded and fixed to the workpiece so as to correct a deviation of the crystal orientation axis of the workpiece in the x axis direction at the time of holding the workpiece by the workpiece holder, a tilt in the y axis direction of the workpiece held by the workpiece plate is adjusted by tilting the workpiece plate bonded and fixed to the workpiece in the y axis direction, and the workpiece is held by the workpiece holder by fixing the workpiece plate and the workpiece to the holder main body at the adjusted tilt, and the workpiece fixed by adjusting the tilt is disposed to the wire saw through the workpiece holder, and the workpiece is pressed against the wire row to slice the workpiece.

6. The method for slicing a workpiece according to claim 5, wherein the two movable pieces each of which has a tapered surface, which comes into contact with the curved tip portion of the protruding portion, tilting at 30° to 60° are used.

7. The method for slicing a workpiece according to claim 5, wherein, as the workpiece holder, adopted is one in which the workpiece plate has the two protruding portions at both ends thereof in the longitudinal direction, the holder main body has the two receiving portions, and the receiving portions sandwiching the curved tip portions of the two protruding portions from the upper and lower sides, respectively.

8. The method for slicing a workpiece according to claim 6, wherein, as the workpiece holder, adopted is one in which the workpiece plate has the two protruding portions at both ends thereof in the longitudinal direction, the holder main body has the two receiving portions, and the receiving portions sandwiching the curved tip portions of the two protruding portions from the upper and lower sides, respectively.

* * * * *